US005423101A

United States Patent [19]

Diefendahl et al.

[11] Patent Number: 5,423,101

[45] Date of Patent: Jun. 13, 1995

[54] DISMOUNTABLE BRIDGE WITH TENSION ELEMENTS AND ADJUSTABLE BOOM

[75] Inventors: Wolfgang Diefendahl, Straelen; Hans-Norbert Wiedeck, Mülheim/Ruhr, both of Germany

[73] Assignee: Krupp Fordertechnik GmbH, Duisburg, Germany

[21] Appl. No.: 160,096

[22] Filed: Dec. 1, 1993

[30] Foreign Application Priority Data

Dec. 1, 1992 [DE] Germany ..... 42 40 270.0

[51] Int. Cl.[6] ..... E01D 15/12

[52] U.S. Cl. ..... 14/2.4; 14/5

[58] Field of Search ..... 14/2.4, 2.5, 2.6, 5, 14/10, 13, 18

[56] References Cited

U.S. PATENT DOCUMENTS 509,781 11/1893 Weiss .
5,293,658 3/1994 Hüther ..... 14/2.4

FOREIGN PATENT DOCUMENTS 0407235 1/1991 European Pat. Off. .
0490094 6/1992 European Pat. Off. .
1091594 10/1960 Germany .
1207948 12/1965 Germany .
3814502 11/1989 Germany .
4137500 5/1993 Germany .

*Primary Examiner*—Michael Powell Buiz
*Assistant Examiner*—Pamela A. O'Connor
*Attorney, Agent, or Firm*—Spencer, Frank & Schneider

[57] ABSTRACT

A dismountable bridge comprises at least one bridge section including a top deck and a bottom boom disposed underneath the top deck. The bottom boom includes a mechanism for adjusting the length of the bottom boom. Rigid end supports each have one end hinged to a respective one of the ends of the top deck and have another end hinged to a respective one of the ends of the bottom boom. Tension elements are disposed laterally of the bridge section and are stressed only tensionally. Each tension element has one end hinged to one end of the top deck and another end hinged to an end of the bottom boom opposite to the one end of the top deck. The bridge section can be changed from a transport position, in which the top deck and the bottom boom are collapsed for maintaining a low height for transporting, and into an operating position in which the top deck is remote from the bottom boom at least at one end of the bridge section.

4 Claims, 3 Drawing Sheets

DISMOUNTABLE BRIDGE WITH TENSION ELEMENTS AND ADJUSTABLE BOOM

CROSS-REFERENCE TO RELATED APPLICATIONS

The present application claims the right of foreign priority with respect to Application No. P 42 40 270.0, filed Dec. 1, 1992, in Germany, the disclosure of which is incorporated herein by reference.

BACKGROUND OF THE INVENTION

The invention relates to a dismountable bridge, comprising at least one bridge section with a top deck, a bottom boom, end supports hinged to the ends of the top deck, and laterally disposed elements, which are only tensionally stressed and which are hinged at the one end to respectively one end of the top deck and at the other end to the respectively opposite end of the bottom boom, wherein the bridge section can be changed from a transport position, in which the top deck and the bottom boom are collapsed for maintaining a low height for transporting, into an operating position in which it is capable of supporting a load and in which the top deck and the bottom boom are remote from each other at least at one end, and vice versa.

Dismountable and collapsible bridges are known which can be transported and assembled at a needed location to provide a path for heavy vehicles, for example, tanks, across and over obstacles such as rivers and ravines. For example, German Patent 1 207 948 discloses a bridge which is assembled from prefabricated components including several inner sections and two ramp sections, each having end supports. The end supports of the ramp sections have a different height than the end supports of the inner sections. Thus, the known collapsible, transportable bridge requires two distinct, structurally different bridge sections, as well as ramp tips. When the sections are transported to a desired location, a possibility of transporting too many or too few of the necessary ramp sections or inner sections exists. For example, if the obstacle to be crossed is of a width requiring a bridge comprising one inner section and two ramps sections, and two inner sections and one ramp section are inadvertently transported instead, the bridge will not cross the obstacle.

It is also known to permanently hinge the end supports by their respective ends to top and bottom booms of the bridge section. Each end support is hinged to be foldable in its middle. Each hinge can be locked to arrest the respective end support in its straight, extended position.

In another known transportable, collapsible bridge there are provided rigid end supports which are required to be removed from the bottom boom to change from a transportation position to an operational, load bearing position.

Regardless of the type of end support used, the end support of the known bridges is disposed between top and bottom booms when in the transport position, which increases the transport height.

SUMMARY OF THE INVENTION

It is an object of the present invention to provide a transportable, collapsible bridge which has only one type of bridge section.

It is a further object of the present invention to design a collapsible bridge section to be multi-functional, so that the bridge section can be used as a ramp, or as an inner bridge section.

It is yet another object of the present invention to improve the transportability of a collapsed bridge section.

The above and other objects are accomplished according to the invention by the provision of a dismountable bridge, comprising: at least one bridge section, including a top deck having two ends; a bottom boom disposed underneath the top deck and having two ends, the bottom boom including adjusting means for adjusting the length of the bottom boom; rigid end supports each having one end hinged to a respective one of the ends of the top deck and having another end hinged to a respective one of the ends of the bottom boom; tension elements each disposed laterally of the bridge section and being stressed only tensionally, each tension element having one end hinged to one end of the top deck and another end hinged to an end of the bottom boom opposite to the one end of the top deck; wherein the bridge section can be changed from a transport position, in which the top deck and the bottom boom are collapsed for maintaining a low height for transporting, and into an operating position in which the top deck is remote from the bottom boom at least at one end of the bridge section.

Thus, with the dismountable bridge according to the invention, the length of the bottom boom can be adjustably set, and the rigid end supports are hingedly connected with the bottom boom in both the transport position as well as in the operating position of the bridge section.

When the bridge section is in its load bearing, operational position, the length of the bottom boom is adjusted to be essentially the same length as the top deck. In this position, each rigid end support is essentially perpendicular to the bottom boom and to the top deck.

On the other hand, in its ramp position, the bridge section forms an essentially right-angled triangle wherein the length of the bottom boom is shortened so that one rigid end support is pivoted to be collinear with the bottom boom. The sum of the lengths of the collinear bottom boom and the one pivoted end support thus form one side of the right triangle, the hypotenuse is formed by the top deck, and the other end support forms the other side of the right triangle.

Further, the length of the bottom boom can be shortened whereby both rigid end supports are pivoted to be linear with the bottom boom, so that the sum of the lengths of the two rigid end supports and the length of the bottom boom is essentially equal to the length of the top deck. This position allows the bottom boom and the rigid end supports to be placed directly underneath and adjacent to the top deck, thus reducing the transport height and bulk.

In order to further reduce the transport height of the bridge section, the top deck may have two lateral wall sections or supports which extend in a downward direction relative to a deck slab connecting the lateral wall sections. The two lateral wall sections and the deck slab form an inverted trough-shaped structure which defines a recess therein. The rigid end supports and the tension elements are hingedly connected to the top deck within the recess so that when transporting the bridge section, the rigid end supports and the bottom boom are pivoted into the recess. Additionally, when the bridge section is used as a ramp using the aforementioned configuration, the climbing height for the vehicles is likewise reduced.

According to the present invention, the bridge section can be used singularly, in pairs, or in combination with any necessary number of bridge sections. When used singularly, for example to cross over relatively narrow obstacles, the bridge section is merely laid over the obstacle in its transport position so that the ends of the top deck are supported on the ground via the end supports which are lying flat. When used in pairs, two bridge sections in their respective ramp positions are connected, raised end to raised end. The bridge section can extend in width over the entire width of the bridge deck, and thus be embodied as a correspondingly wide track element. Alternatively, the bridge section can be positioned parallel to and alongside any number of further bridge sections, each bridge section thus forming a distinct track element and being connected to each corresponding bridge section adjacent thereto by means of a common cross brace.

When a bridge section is in either its transport or ramp position, at least one end of the top deck is supported on the ground on a corresponding horizontal one of the rigid end supports. To distribute the load evenly, the rigid end supports preferably comprise a planar support surface which extends through the hinge axes in the top deck or slightly parallel thereto.

To make it easier for vehicles to drive up on a bridge consisting of only a single bridge section, the top deck is configured as a deck slab in which the distance from the bottom boom is greater at the center region of the deck slab than at the two ends thereof. Thus, the ends of the deck slab are made relatively flat. In a preferred embodiment of the invention, the distance of the deck slab from the bottom support is preferably constant at the center region of the top deck, and thereafter continuously decreases toward the deck ends.

Exemplary embodiments of the subject of the invention are illustrated in the drawings and will be described in detail below.

DETAILED DESCRIPTION OF THE PREFERRED EMBODIMENTS

Figure 1:
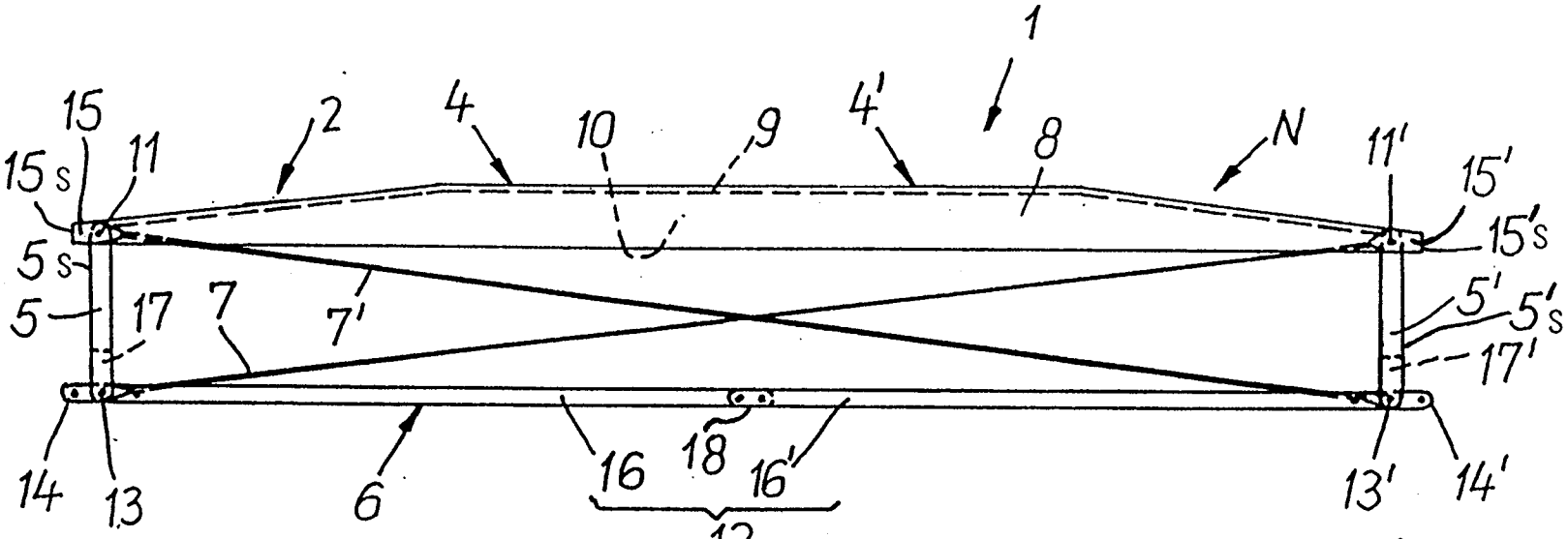
FIG. 1 is a side elevational view of an embodiment of a bridge section according to the present invention, where the bridge section is in an operational position.

A bridge section 1 embodied as a normal or mid section N is illustrated in FIG. 1 in its operational position. Bridge section 1 constitutes a track element 2 comprising a top chord or deck 4, two end supports 5, 5', a bottom boom or support member 6 and tension elements 7, 7' which are only tensionally stressed. Top deck 4 includes a deck slab 9 and lateral supports or girders 8 connected by deck slab 9.

Figure 4:
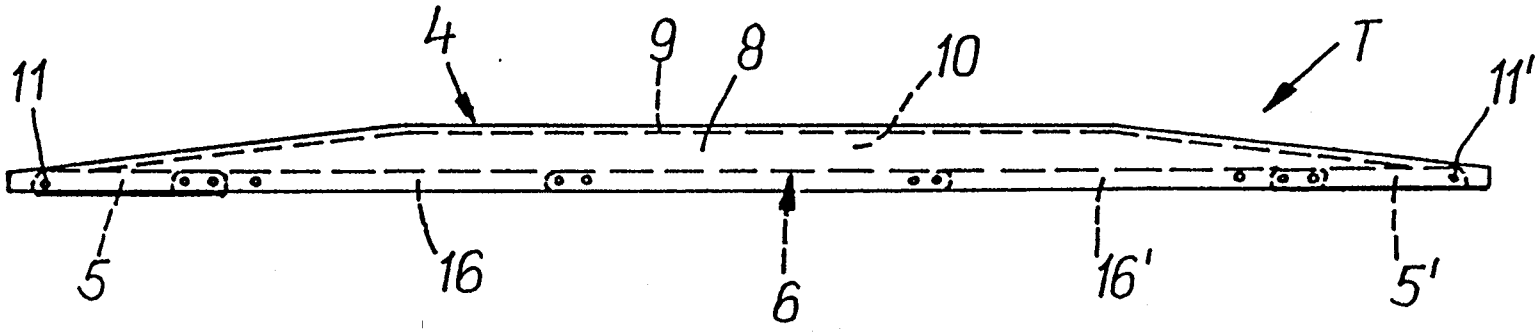
FIG. 4 is a side elevational view of the bridge section of FIG. 1 in the transport position.

Lateral supports 8 have a height which is constant at center region 4' of top deck 4 but which decreases in a direction toward the two ends of top deck 4. Both lateral supports 8 are connected at their upper edges by deck slab 9. Together, lateral supports 8 and deck slab 9 represent a trough-shaped structural component which faces toward the bottom chord or boom 6 and which thereby defines a recess 10 within top deck 4. Rigid end supports 5, 5' are hingedly seated at both ends of top deck 4 inside recess 10 on the insides of lateral supports 8 around horizontal hinge axes 11 and 11', which extend perpendicularly to a plane comprising tension elements 7 and 7'. Each of rigid end supports 5, 5' is formed as a planar support element including support surface 5s, 5s' thereon, the imaginary main plane of supports 5, 5' is determined by the associated hinge axes 11 and 11'. Rigid end supports 5, 5' can thus either be housed inside recess 10 and disposed parallel to bottom boom 6 as indicated in FIG. 4, or, alternatively, be pivoted 90° about hinge axes 11, 11' with respect to bottom boom 6 such that they assume a vertical position as shown in FIG. 1.

Bottom boom 6 consists of two supports or tracks 12 per track element 2, and is hinged to the bottom ends of the rigid end supports 5, 5' adjacent the actual ends 14 and 14' of bottom boom 6. The corresponding hinge axes are indicated by 13, 13' in FIG. 1. Actual ends 14, 14' of bottom boom 6 extend beyond hinge axes 13, 13' in order to allow a tension resisting connection with the bottom boom of an adjoining bridge section in a multi-section bridge configuration.

Top deck 4 also extends beyond the hinge axes 11, 11'. However, the actual ends 15, 15' of top deck 4 are not intended for a tension resisting connection with the top deck of an adjoining bridge section; instead, they are configured to include pressure surfaces 15s and 15s' thereon.

Tension elements 7, 7' can be in the form of cables. On each side of track element 2, a cable 7' is hinged diagonally at one end thereof to the hinge axis 11 at top deck 4 and at another end thereof on the hinge axis 13' at bottom boom 6. The other cable 7 is also disposed diagonally, with one end thereof being hinged at the hinge axis 13 and with another end thereof being hinged at the hinge axis 11'. In the support or operational position of the bridge section as illustrated in FIG. 1, bottom boom 6 extends parallel with the top deck 4 and cables 7, 7' have a slight prestress in the non-loaded state of the bridge section. However, the tension elements can also be embodied as telescoping tension diagonal braces, as disclosed in the above-mentioned German Patent 1 207 948.

Each of the supports or tracks 12 of bottom boom 6 is comprised of two parts 16, 16' having an adjusting mechanism 18 for adjusting the length of bottom boom 6. Thus, while the support part 16' is embodied to be fork- or pipe-shaped on its end adjacent part 16, part 16 has on its end adjacent part 16' a cross section which can slide inside the fork- or pipe-shaped end of part 16'. Both parts 16, 16' have crosswise bores and can be adjusted to a desired effective length of bottom boom 6 with bolts (not shown). The length between hinge axes 13 and 13' is here understood to be the effective length of bottom boom 6. Similarly, the length between the hinge axes 11 and 11' is understood to represent the effective length of top deck 4, while the effective lengths of rigid end supports 5 and 5' are defined between hinge axes 11 and 13, and 11' and 13' respectively. In the case of section N illustrated in FIG. 1, the effective length of bottom boom 6 is equal to the effective length of top deck 4.

Figure 2:
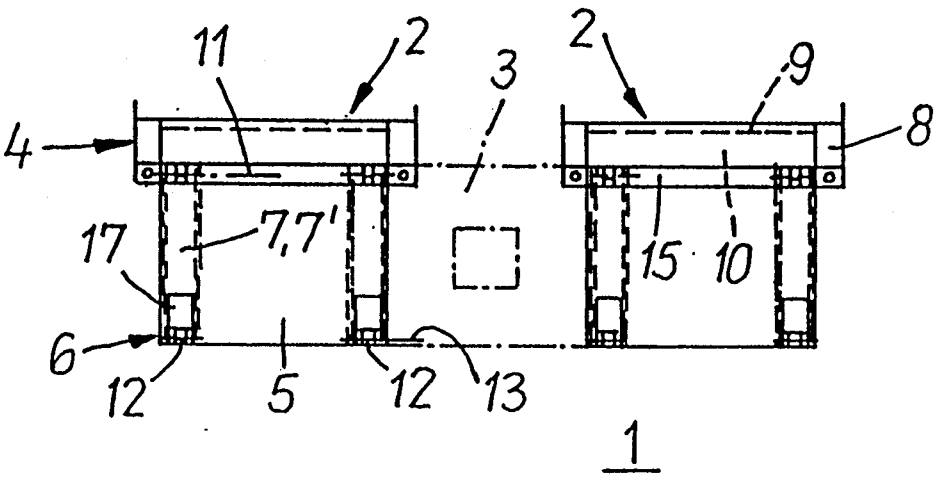
FIG. 2 is a front elevational view of a further embodiment of the bridge section of FIG. 1, where two bridge sections are shown as forming two distinct track elements.

In the embodiment shown in FIG. 2, bridge section 1 consists of two bridge sections 2 connected by a common cross brace 3, shown in dash-dotted lines. However, bridge section 1 can also extend in width over the entire width of the bridge deck and be embodied as a correspondingly wide bridge section.

Figure 3:
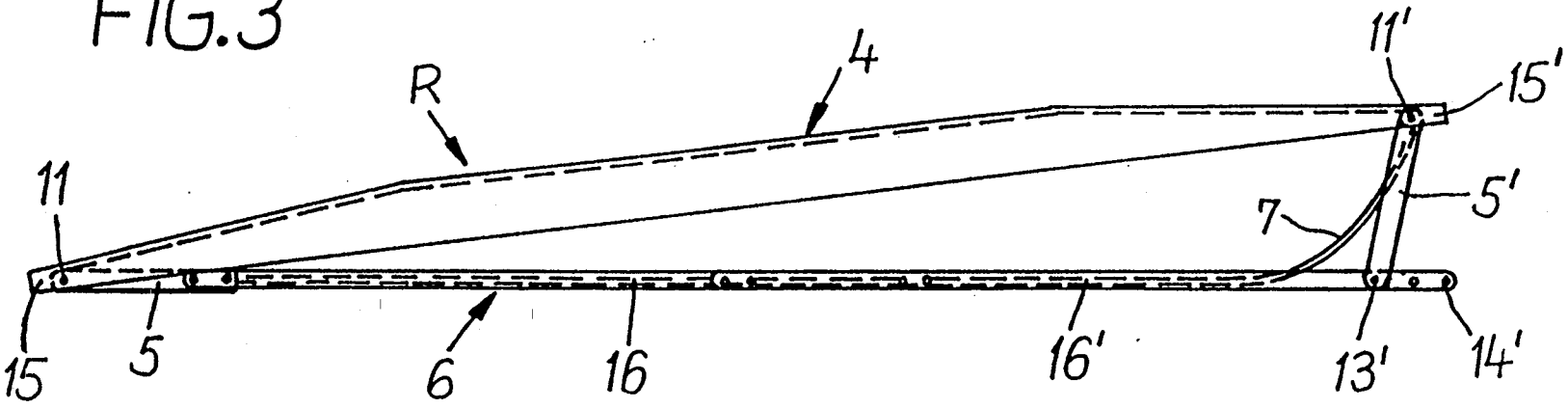
FIG. 3 is a side elevational view of the bridge section of FIG. 1 in the ramp position.

In FIG. 3, the shown bridge section, which is of the same construction as the bridge section of FIG. 1, is formed as a ramp field or ramp section R, and is thus in its ramp position.

In this position of the bridge section, the effective length of bottom boom 6 is shortened in comparison to its effective length in an operational position of the bridge section.

As shown in FIG. 3, top deck 4 rests on the flat-lying rigid end support 5 at its end 15. Because of the flat embodiment of the rigid end support here, a good distribution of the load and therefore a reduction of the specific load per surface unit is achieved. Right end 15' of top deck 4 is supported on the rigid end support 5', which has been slightly slanted for a correct adjustment of the height of right end 15' of the top deck. The left rigid end support 5 has been pivoted to be coplanar with bottom boom 6. For this reason, the effective length of the bottom boom has been appropriately shortened, i.e. parts 16, 16' have been appropriately displaced and fixed by way of adjusting means 18. Except for the slight slant of the rigid end support 5', the sum of the effective lengths of rigid end support 5 and bottom boom 6 corresponds to the horizontal projection of the effective length of top deck 4. In other words, rigid end support 5 and bottom boom 6 together represent one side of an approximately right-angled triangle, the hypotenuse of which is formed by top deck 4, and the third side of which is formed by rigid end support 5'. In order for support parts 16, 16' to be able to assume this position, rigid end supports 5, 5' are provided with appropriate recesses 17, 17' therein for the ends 14, 14' (see FIG. 1).

In the ramp position of the bridge section, tension elements 7, 7' are inactive and rest on bottom boom 6.

In the transporting state or transport position T of the bridge section shown in FIG. 4 (regardless of whether in the individual instances it is used as a ramp or a normal section), the effective length of bottom boom 6 has been further shortened so that the effective lengths of the two rigid end supports 5, 5' and the effective length of support 12 together correspond to the effective length of the top deck 4. In this state the two rigid end supports 5, 5' and bottom boom 6 are located in a common plane within recess 10 of top deck 4. In order to prevent bottom boom 6 from projecting downward during loading of the bridge section, it is secured on lateral supports 8 of top deck 4 by means of socket pins (not shown).

Because the bottom boom needs to have only a total of three different effective lengths corresponding to the three different positions of the bridge section, that is, the operational position of a normal or mid section, the ramp position, and the transport position, these effective lengths can be easily set by means of appropriate bolt holes, which obviate the need for cumbersome adjustments of the assembly.

Figure 5:
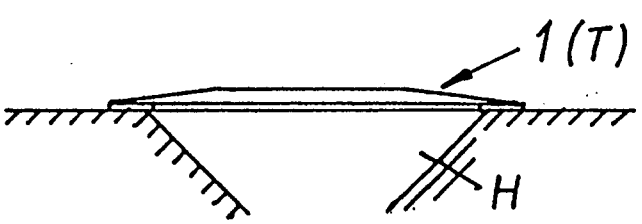
FIG. 5 is a side elevational view of a bridge formed by a single bridge section extending over a short or narrow obstacle.

FIG. 5 shows a short bridge which is, for example, 5.5 m in length, and which is formed by a single bridge section 1 placed in the transport position T. The short bridge rests with both of its ends on the banks of a short or narrow obstacle H, and is supported by rigid end supports 5, 5' in their pivoted or flat position.

Figure 6:
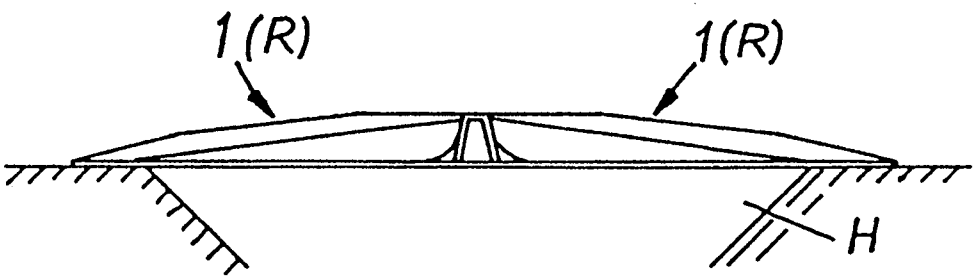
FIG. 6 is a side elevational view of a bridge composed of two bridge sections extending over an obstacle.

FIG. 6 shows a bridge composed of two ramp sections, i.e. two bridge sections 1 in ramp arrangement R.

Figure 7:
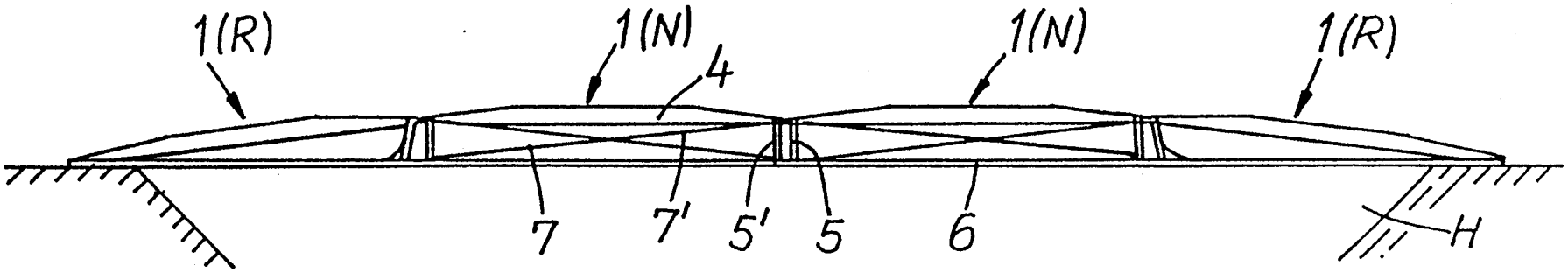
FIG. 7 is a side elevational view of a bridge composed of four bridge sections extending over an obstacle.

Finally, FIG. 7 shows a bridge which is 22 m in length, and which is composed of four identical bridge sections 1, the two end sections of which are in ramp position R, and the two center sections of which are in the operational position N.

As shown in FIGS. 5, 6, and 7, it is therefore possible to construct bridges of different lengths with the same modularly embodied bridge sections 1.

The foregoing is a complete description of the present invention. Various changes may be made without departing from the spirit and scope of the invention. The invention, therefore, should be limited only by the scope of the claims which follow.

What is claimed is:

1. A dismountable bridge, comprising:

at least one bridge section, including a top deck having two ends;

a bottom boom disposed underneath said top deck and having two ends, said bottom boom including adjusting means for adjusting the length of said bottom boom;

rigid end supports each having one end hinged to a respective one of the ends of said top deck and having another end hinged to a respective one of the ends of said bottom boom;

tension elements each disposed laterally of said bridge section and being stressed only tensionally, each said tension element having one end hinged to one end of said top deck and another end hinged to an end of said bottom boom opposite to the one end of said top deck;

wherein the bridge section can be changed from a transport position, in which the top deck and the bottom boom are collapsed for maintaining a low height for transporting, and into an operating position in which said top deck is remote from said bottom boom at least at one end of said bridge section.

2. A bridge in accordance with claim 1, wherein said top deck comprises two lateral supports each having a lower edge, and a deck slab connecting said lateral supports so that said top deck presents a recess that is open toward said bottom boom, and said end supports and said tension elements are hinged inside said recess between said lateral supports and above the lower edge of said lateral supports.

3. A bridge in accordance with claim 1, wherein said end supports each have a hinge axis defined where said end supports are hinged to said top deck and said end supports each have a flat form that includes a support surface and an imaginary main plane which is essentially determined by the hinge axis.

4. A bridge in accordance with one of claims 1, wherein said top deck has a greater height in its center than at the ends.

* * * * *